US007670122B2

(12) United States Patent
Phillips et al.

(10) Patent No.: US 7,670,122 B2
(45) Date of Patent: Mar. 2, 2010

(54) GEROTOR PUMP

(75) Inventors: Edward H. Phillips, Troy, MI (US); Jeffrey M. Lloyd, Auburn Hills, MI (US)

(73) Assignees: ArvinMeritor Technology, LLC, Troy, MI (US); Techco Corp., Southfield, MI (US)

( * ) Notice: Subject to any disclaimer, the term of this patent is extended or adjusted under 35 U.S.C. 154(b) by 489 days.

(21) Appl. No.: 11/504,287

(22) Filed: Aug. 15, 2006

(65) Prior Publication Data

US 2008/0031760 A1 Feb. 7, 2008

(51) Int. Cl.
*F03C 2/00* (2006.01)
*F03C 4/00* (2006.01)
*F04C 18/00* (2006.01)

(52) U.S. Cl. ..... 418/196; 418/150; 418/171; 418/199

(58) Field of Classification Search ..... 418/15, 418/61.3, 75, 77, 166, 171, 196, 199, 150
See application file for complete search history.

(56) References Cited

U.S. PATENT DOCUMENTS

| | | | | | |
|---|---|---|---|---|---|
| 2,732,802 | A * | 1/1956 | Eames, Jr. | ..... | 418/15 |
| 3,917,437 | A * | 11/1975 | Link | ..... | 418/61.3 |
| 4,898,249 | A * | 2/1990 | Ohmori | ..... | 173/176 |
| 5,595,479 | A | 1/1997 | Hansen | | |
| 6,540,635 | B1 | 4/2003 | Sano | | |
| 6,540,637 | B2 * | 4/2003 | Bachmann et al. | ..... | 475/162 |
| 6,695,603 | B2 | 2/2004 | Bachmann | | |
| 2004/0101427 | A1 | 5/2004 | Yu | | |

FOREIGN PATENT DOCUMENTS

| | | | | | |
|---|---|---|---|---|---|
| DE | 3432704 | A1 * | 3/1986 | ..... | 418/171 |
| DE | 19646359 | | 5/1998 | | |
| GB | 2110759 | A * | 6/1983 | ..... | 418/171 |
| WO | WO 03/052272 | A1 | 6/2003 | | |

OTHER PUBLICATIONS

Modelling and Simulation of Gerotor gearing in Lubricating Oil Pumps, 1999 Society of Automotive Engineers, Inc., 99P-464, Fabiani, Manco, Rundo.

* cited by examiner

*Primary Examiner*—Theresa Trieu
(74) *Attorney, Agent, or Firm*—Carlson, Gaskey & Olds PC

(57) ABSTRACT

A gerotor pump includes an outer rotor having a first toothed surface and lobes that extend inwards. An inner rotor is eccentrically aligned relative to the outer rotor and includes a second toothed surface and lobes that extend outwards. Planetary gears are located between the outer rotor and the inner rotor. Each planetary gear has a third toothed surface that intermeshes with the first toothed surface and the second toothed surface.

11 Claims, 2 Drawing Sheets

GEROTOR PUMP

BACKGROUND OF THE INVENTION

This invention relates to pumps and, more particularly, to gerotor pumps having eccentrically aligned rotor gears.

Gerotor pumps comprising eccentrically aligned rotor gears are widely known and used, for example, as fluid pumps. Conventional gerotor pumps typically include an inner rotor having lobes that extend radially outward and an outer rotor that has lobes that extend radially inward. The inner rotor rotates about an eccentric axis relative to the outer rotor to create compression chambers between the lobes of the outer rotor and lobes of the inner rotor. The eccentric rotation decreases the compression chamber size between a low pressure suction side of the pump and a high pressure discharge side of the pump to pump the fluid.

Conventional gerotor pumps have several significant drawbacks. For one thing, it is difficult to maintain a seal between the inner rotor and the outer rotor during operation, especially at low speed, high pressure conditions. This may allow fluid to prematurely escape from the compression chambers, which reduces the pumping efficiency. Additionally, some gerotor pumps that incorporate planetary gears between the rotors do not form seals between the surfaces of the planetary gears and the rotors. Planetary gear gerotor pumps are also susceptible to seizing up when radial forces between the rotors and the planetary gears become too high. As a result, pump maintenance or replacement may be necessary.

SUMMARY OF THE INVENTION

An example gerotor pump includes an outer rotor having a first toothed surface and lobes that extend inward. An inner rotor is eccentrically aligned relative to the outer rotor and includes a second toothed surface and lobes that extend outwards. Planetary gears are located between the outer rotor and the inner rotor. Each planetary gear has a third toothed surface that engages the first toothed surface and the second toothed surface.

An example gerotor pump system includes a first gerotor pump and a second gerotor pump arranged in parallel with the first gerotor pump. Each gerotor pump includes planetary gears that revolve between an outer rotor and an inner rotor. The planetary gears of the first gerotor are oriented out of phase relative to the planetary gears of the second gerotor. Additional gerotor pumps may also be used in the parallel arrangement.

An example method for use with a gerotor pump includes the step of revolving toothed planetary gears along a path that extends between a toothed inner rotor and a toothed outer rotor to pump a fluid.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
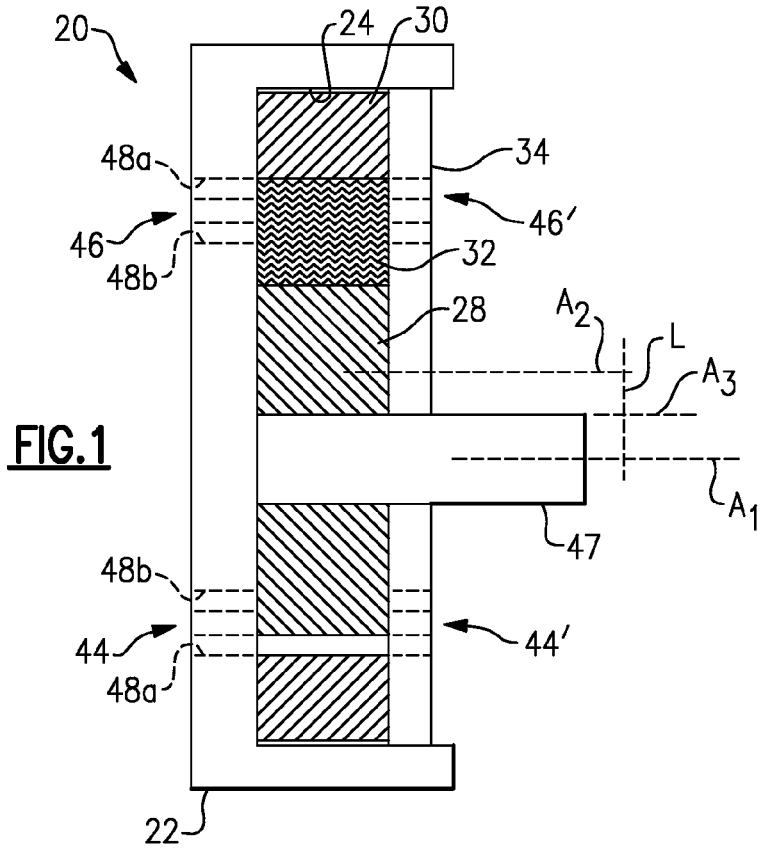
FIG. 1 illustrates an axial cross-sectional view of an example gerotor pump.
Figure 2:
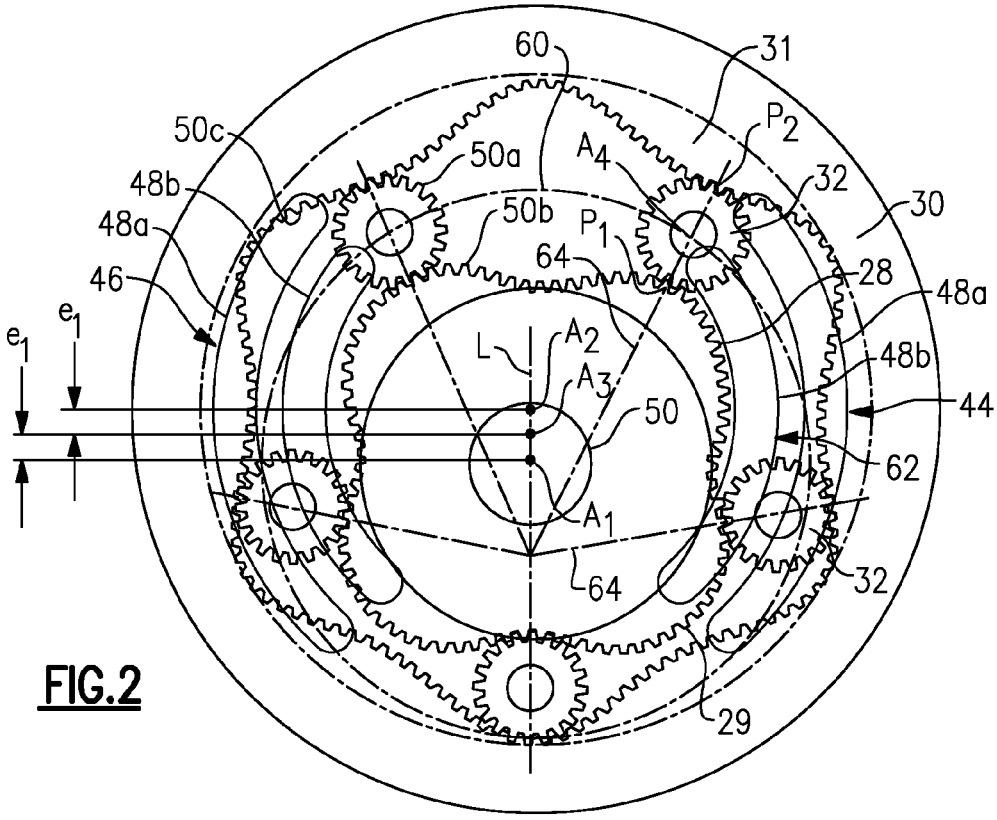
FIG. 2 illustrates a radial cross-sectional view of the gear sets of the gerotor pump depicted in FIG. 1.

FIGS. 1 and 2 illustrate simplified schematic views of selected portions of an example gerotor pump 20 for efficiently pumping a fluid and avoiding maintenance problems such as seizure. In this example, the gerotor pump 20 includes a housing 22 having a pocket 24 that contains an inner rotor 28 having lobes 29 that extend outward, and an outer rotor 30 (i.e., gear sets). In this example, the outer rotor 30 is a ring gear having lobes 31 that extend inwards. A selected number, N, of planetary gears 32 are received between the inner rotor 28 and the outer rotor 30 for revolution about the inner rotor 28 and simultaneous revolution within the outer rotor 30.

In this example, a cover 34 retains the rotors 28, 30 and planetary gears 32 within the pocket 24. The cover 34 is secured to the housing 22 in a known manner to provide a sealed chamber in which the rotors 28, 30 and planetary gears 32 operate.

The housing 22 includes an inlet port 44 and an outlet port 46. Each of the inlet port 44 and the outlet port 46 includes a first slot 48*a* and a second slot 48*b* that is parallel to and radially inward of the first slot 48*a*. This "split slot" configuration provides the advantage of providing an unrestrictive flow path while preventing the planetary gears 32 from falling into the ports 44 and 46 as they revolve next to the ports 44 and 46. Alternatively, the inlet port 44, the outlet port 46, or both are ported through the cover 34 instead of the housing 22 (as seen in phantom at 44' and 46'), depending on the particular needs of a design.

The inner rotor 28 is operatively coupled with a drive shaft 47 along an axis $A_1$. The outer rotor 30 rotates about a central axis $A_2$ that is eccentric relative to the inner rotor 28 rotational axis $A_1$, and the planetary gears 32 revolve about a central axis $A_3$. In the disclosed example, the axes $A_1$, $A_2$, and $A_3$ align collinearly along a line L (FIG. 2) that extends in a direction perpendicular to the first central axis $A_1$ and are offset from each other. In this example, the axis $A_1$ is offset a magnitude, $e_1$, from axis $A_3$, and the axis $A_2$ is offset an equal magnitude $e_1$ from axis $A_3$. In one example, the offset value $e_1$ is used to model the profile shape of the lobes 29 and 31. In a further example, the profile shapes of the lobes 29 and 31 are modeled from the offset value $e_1$ using a known modeling technique, such as SAE 99P-464 entitled "Modeling and Simulation of Gerotor Gearing in Lubricating Oil Pumps."

In the illustrated example, the gerotor pump 20 includes five planetary gears 32 (i.e., N=5); however, it is to be understood that the benefits described in this description will also be applicable to pumps having different numbers of planetary gears 32. The number of planetary gears may be selected during a design stage of the gerotor pump 20 and determines the configuration of the rotors 26. In one example, for N planetary gears 32, the inner rotor 28 has N−1 lobes 29 and the outer rotor 30 has N+1 lobes 31. Thus, in the illustrated example, there are four lobes 29 of the inner rotor 28 and six lobes 31 of the outer rotor 30.

The planetary gears 32 each include teeth 50*a*. The teeth 50*a* intermesh with corresponding teeth 50*b* and 50*c* on the inner rotor 28 and the outer rotor 30, respectively.

Similar to the relationship between the number of planetary gears 32 and the number of lobes 29 and 31, a number X of teeth 50*a* on the planetary gears 32 determines the number of teeth 50*b* and 50*c* on the inner rotor 28 and outer rotor 30, respectively. In one example, for X teeth 50*a* and N planetary gears 32, the inner rotor has X·(N−1) teeth 50*b* and the outer rotor 30 has X·(N+1) teeth 50*c*. The relationship between the number N of planetary gears 32 and its number X of teeth 50*a* and the number of lobes 29 and 31 and number of teeth 50*b* and 50*c* of the inner rotor 28 and the outer rotor 30, respectively, provides the benefit of forming a tight seal between the planetary gears 32 and the rotors 28, 30 to increase the pumping efficiency.

The relationship between the number N of planetary gears 32 and its number X of teeth 50*a* and the number of lobes 29 and 31 and number of teeth 50*b* and 50*c* of the inner rotor 28 and the outer rotor 30, respectively, in the disclosed example also provides a desirable rotational speed relationship. For X teeth 50*a* and N planetary gears 32 that rotate about the axis $A_3$ with a speed Z, the inner rotor 28 rotates at a speed of Z·N/(N−1) and the outer rotor rotates at a speed of Z·N/(N+1). In this example, each of the planetary gears 32 travels over one of the lobes 29 of the inner rotor 28 and one of the lobes 31 of the outer rotor 30 with each revolution about the axis $A_3$.

In operation, the drive shaft 47 rotates the inner rotor 28. This in turn drives the planetary gears 32 to revolve along a path 60 about central axis $A_3$ and rotates the outer rotor 30 about its axis $A_2$. In the illustrated configuration, the planetary gears 32 accelerate from a "short side" (i.e., the bottom in FIG. 2) to a "long side" (i.e., the top in FIG. 2) and decelerate from the "long side" to the "short side." As the planetary gears 32 revolve, fluid enters through the inlet port 44 into compression chambers 62 between the planetary gears 32. The planetary gears 32 reduce the size of the compression chamber 62 along the path 60 between the inlet port 44 and the outlet port 46 to compress the fluid. The compressed fluid is then discharged through the outlet port 46.

The correspondence between the number of planetary gears 32 and the number of lobes 29 and 31, and the correspondence between the number of teeth 50*a* on the planetary gears 32 and the number of teeth 50*b* and 50*c* on the inner rotor 28 and the outer rotor 30 provides the benefit of maintaining a desired operational relationship between the planetary gears 32, the inner rotor 28, and the outer rotor 30. As seen in FIG. 2, the planetary gears 32 maintain a tangential relationship with the inner rotor 28 and the outer rotor 30 along the path 60. Each of the planetary gears 32 maintains a first tangent point $P_1$ between each of the planetary gears 32 and the inner rotor 28 and a second tangent point $P_2$ between each of the planetary gears 32 and the outer rotor 30 such that the tangent points $P_1$ and $P_2$ are collinear (designated with lines 64) with a central axis $A_4$ of each of the planetary gears 32 entirely along the path 60. The lines 64 intersect at point C, also known as the pitch circle contact point. Maintaining this tangential relationship provides the benefit of directing radial forces from the inner rotor 28 to the outer rotor 30 through the centers of the planetary gears 32 to prevent sliding and maintain a tight seal between the interlocking teeth 50*a*, 50*b*, and 50*c*. This in turn prevents fluid escape from the compression chambers 62 to provide efficient pumping, which is a drawback with some prior gerotor pumps.

Figure 3:
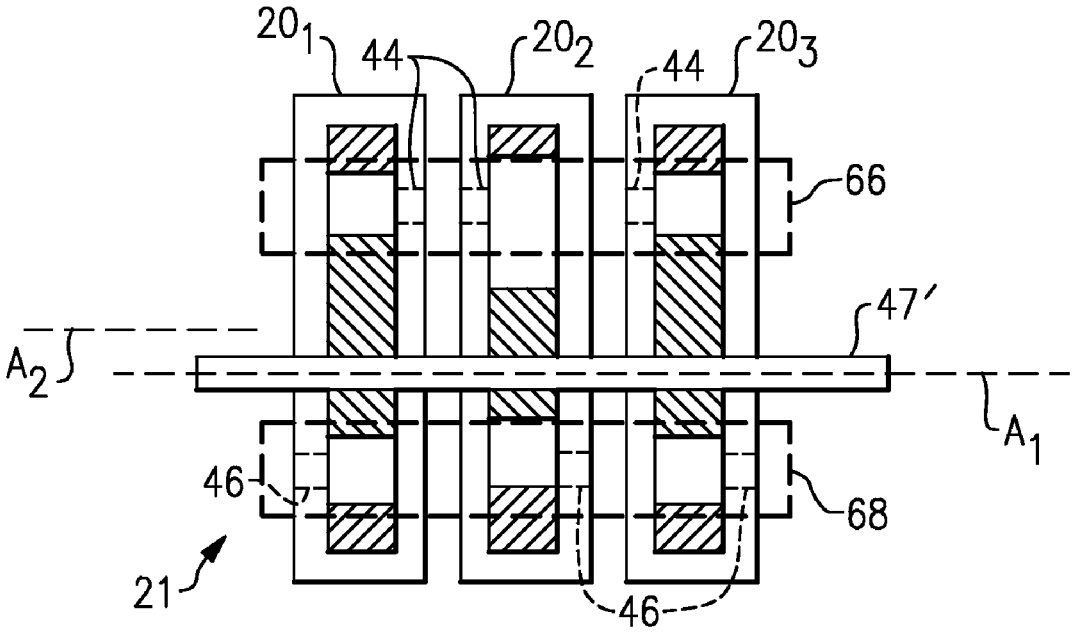
FIG. 3 illustrates an example gerotor pump system having multiple gerotor pumps in parallel.

FIG. 3 illustrates a simplified schematic view of an embodiment having a gerotor pump system 21 comprising multiple gerotor pumps $\mathbf{20}_1$, $\mathbf{20}_2$, and $\mathbf{20}_3$ arranged in parallel. In the illustrated example, the gerotor pumps $\mathbf{20}_1$, $\mathbf{20}_2$, and $\mathbf{22}_3$ are similar to the gerotor pump 20 described in the above example. In this example, the gerotor pumps $\mathbf{20}_1$, $\mathbf{20}_2$, and $\mathbf{20}_3$ have progressively offset planetary gear 32 sets. That is, the planetary gears 32 of the gerotor pump $\mathbf{20}_2$ are offset by an angle relative to the planetary gear sets 32 of the gerotor pumps $\mathbf{20}_1$ and $\mathbf{20}_3$. Likewise, the planetary gears 32 of the gerotor $\mathbf{20}_1$ are offset from the planetary gears 32 of the gerotor pump $\mathbf{20}_3$. The drive shaft 47' drives all three of the gerotor pumps $\mathbf{20}_1$, $\mathbf{20}_2$, and $\mathbf{20}_3$ in this example. Fluid enters into each inlet port 44 of the gerotor pumps $\mathbf{20}_1$, $\mathbf{20}_2$, and $\mathbf{20}_3$ from a common inlet manifold 66 and is discharged from each outlet port 46 into a common outlet manifold 68.

Generally, a single gerotor pump 20 produces fluid flow ripples as the chambers 62 discharge the fluid through the outlet port 46. In some instances, it is desirable to reduce the magnitude of the ripples (i.e., a difference between a maximum fluid flow and a minimum fluid flow through the outlet port 46) to, for example, promote quieter operation.

In the disclosed example, each gerotor pump 20 within the gerotor pump system 21 has the same number N planetary gears 32. This provides the benefit of minimizing fluid flow ripple issuing from a gerotor pump system 21.

Figure 4:
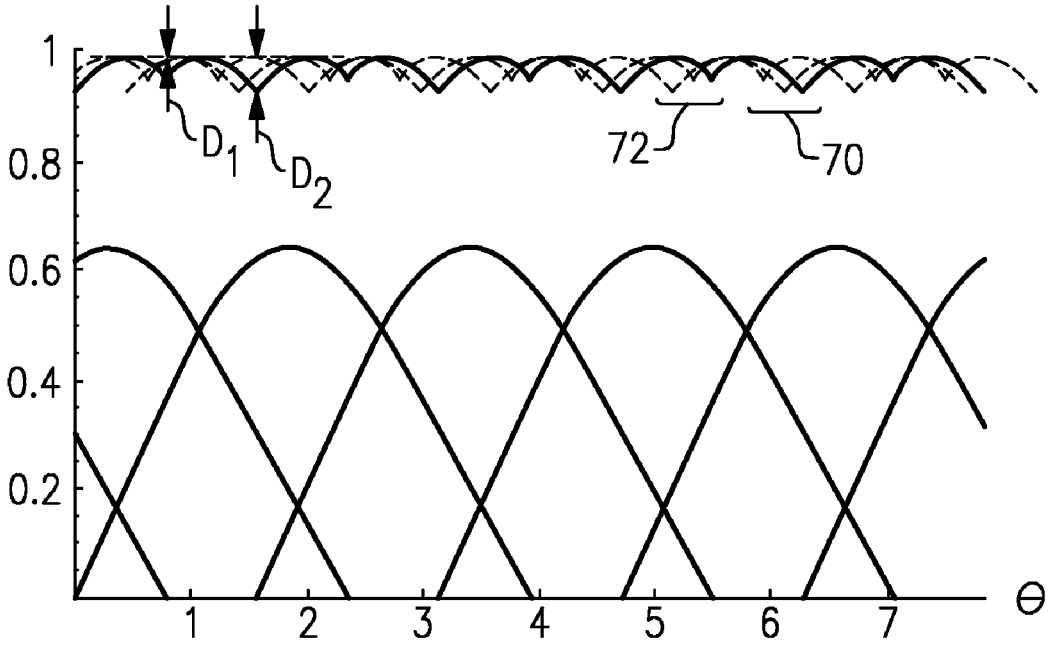
FIG. 4 illustrates example output fluid flow curves of the gerotor pump system of FIG. 3.

In one example demonstrated by FIG. 4, the gerotor system 21 includes an odd number M of gerotor pumps $\mathbf{20}_1$ through $\mathbf{20}_M$. The gerotor pumps $\mathbf{20}_1$ through $\mathbf{20}_M$ have progressively offset planetary gear 32 sets. In the disclosed example, the offset is an angle with respect to the direction of rotation of the drive shaft 47' and is a function of the number M of gerotor pumps 20 in the gerotor pump system 21 and the number N of planetary gears 32 in each gerotor pump 20. In a further example, the offset angle equals 2·360°/(M·N).

In this example, M=3 and N=5 whereby the desired progressive offset angle is 2·360°/(3·5)=48° such that the planetary gears 32 of the gerotor pumps $\mathbf{20}_1$, $\mathbf{20}_2$, and $\mathbf{20}_3$ are oriented 48° out of phase from each other. For example, if the direction of rotation of the drive shaft 47' is clockwise, the planetary gears of the second gerotor pump $\mathbf{20}_2$ are oriented 48° in a clockwise direction from the first gerotor pump $\mathbf{20}_1$, and the planetary gears of the third gerotor pump $\mathbf{20}_3$ are oriented 48° in a clockwise direction from the second gerotor pump $\mathbf{20}_2$. Thus as will be apparent from an inspection of FIG. 4 below, the out of phase orientation provides the benefit of offsetting the fluid flow ripples produced by each of the gerotor pumps $\mathbf{20}_1$, $\mathbf{20}_2$, and $\mathbf{20}_3$ to reduce the magnitude of the resulting output fluid flow ripple.

The example illustrated in FIG. 4 shows a graph of relative volume of fluid flow versus radians (relative to rotation of the inner rotors 28) for the three gerotor pumps $\mathbf{20}_1$, $\mathbf{20}_2$, and $\mathbf{20}_3$. The curves near the bottom of the graph represent the relative volume of fluid flow curves of the compression chambers 62 of a single gerotor pump 20 as the compression chamber 62 receives, compresses, and discharges fluid. The three curves near the top represent the total relative volume flow (which is proportional to fluid flow) of the respective gerotor pumps $\mathbf{20}_1$, $\mathbf{20}_2$, and $\mathbf{20}_3$. The three curves are offset by 48° in this example because of the 48° offset angle between the planetary gears 32 of the gerotor pumps $\mathbf{20}_1$, $\mathbf{20}_2$, and $\mathbf{20}_3$. As can be appreciated, the individual curves near the bottom of the graph depict the fact that in each of the gerotor pumps 20 there is finite asymmetry in fluid flow from each of the compression chambers 62. Thus, it will be appreciated that progressively offsetting each of the M gerotor pumps $\mathbf{20}_1$ through $\mathbf{20}_M$ at an angle of 2·360°/(M·N) rather than by an angle of 360°/(M·N) results in dispersing sets of three absolute minimum fluid flow cusps 70 (i.e., in this case at 2·360°/(M·N)=48° rather than sets of three in succession at 360°/(M·N)=24° followed by sets of three reduced magnitude cusps 72). In any case, it can be observed that the difference $D_1$ in magnitude between the peaks and valleys of the three fluid flow curves is significantly smaller than the difference $D_2$ between the peaks and valleys of any single curve. Thus, using multiple gerotor pumps $\mathbf{20}_1$, $\mathbf{20}_2$, and $\mathbf{20}_3$ provides the benefit of reducing the magnitude of output fluid flow ripple. It is to be understood that although the example illustrates use of three gerotor pumps $\mathbf{20}_1$, $\mathbf{20}_2$, and $\mathbf{20}_3$, in general, fewer pumps or additional pumps may be used as desired.

Although a preferred embodiment of this invention has been disclosed, a worker of ordinary skill in this art would recognize that certain modifications would come within the scope of this invention. For that reason, the following claims should be studied to determine the true scope and content of this invention.

We claim:

1. A gerotor pump comprising:

an outer rotor having a first toothed surface with inwardly extending lobes;

an inner rotor that is eccentrically aligned relative to said outer rotor and includes a second toothed surface with outwardly extending lobes; and planetary gears between said outer rotor and said inner rotor, said planetary gears each having a third toothed surface that intermeshes with said first toothed surface and said second toothed surface, wherein for N number of planetary gears and X number of teeth on said third toothed surface of said planetary gears, there are $X\cdot(N+1)$ teeth on said first toothed surface and $X\cdot(N-1)$ teeth on said second toothed surface.

2. A gerotor pump comprising:

an outer rotor having a first toothed surface with inwardly extending lobes;

an inner rotor that is eccentrically aligned relative to said outer rotor and includes a second toothed surface with outwardly extending lobes; and planetary gears between said outer rotor and said inner rotor, said planetary gears each having a third toothed surface that intermeshes with said first toothed surface and said second toothed surface, wherein for a rotation rate Z of N number of said planetary gears about a central axis, said outer rotor rotates at a rate of $Z\cdot N/(N+1)$ and said inner rotor rotates at a rate of $Z\cdot N/(N-1)$.

3. The gerotor pump as recited in claim 2, wherein said central axis comprises an intersection point of N number of lines that each corresponds to a different one of said planetary gears, wherein each of said lines extends through a second tangent point between said corresponding planetary gear and said outer rotor and a first tangent point between said corresponding planetary gear and said inner rotor.

4. A gerotor pump comprising:

an outer rotor having a first toothed surface with inwardly extending lobes;

an inner rotor that is eccentrically aligned relative to said outer rotor and includes a second toothed surface with outwardly extending lobes; and planetary gears between said outer rotor and said inner rotor, said planetary gears each having a third toothed surface that intermeshes with said first toothed surface and said second toothed surface, said planetary gears rotate as a group about a third central axis, said outer rotor rotates about a second central axis, and said inner rotor rotates about a first central axis, and said first central axis, said second central axis, and said third central axis are offset from each other.

5. The gerotor pump as recited in claim 4, further comprising a port having a first slot and a second slot that is spaced radially inward of said first slot relative to said outer rotor.

6. The gerotor pump as recited in claim 5, wherein said first slot and said second slot each comprise an elongated arcuate slot.

7. The gerotor pump as recited in claim 6, wherein said elongated arcuate slots are parallel to each other.

8. The gerotor pump as recited in claim 5, wherein said planetary gears revolve along a path about said inner rotor as said inner rotor rotates, wherein said path is directly adjacent said first slot and said second slot.

9. The gerotor pump as recited in claim 4, wherein for N number of planetary gears, there are N+1 inwardly extending lobes and N−1 outwardly extending lobes.

10. The gerotor pump as recited in claim 4, wherein each of said first central axis, said second central axis, and said third central axis is equidistantly offset from at least one other of said first central axis, said second central axis, or said third central axis.

11. The gerotor pump as recited in claim 4, wherein said first central axis, said second central axis, and said third central axis are aligned along a line that extends in a direction perpendicular to the first central axis.

* * * * *